US005148741A

United States Patent [19]

Hickman et al.

[11] Patent Number: 5,148,741

[45] Date of Patent: Sep. 22, 1992

[54] METHOD AND APPARATUS FOR REFLECTIVE ENHANCEMENT OF ROTOGRAVURE PRINTED MATERIAL

[75] Inventors: Lawrence G. Hickman, Glen Allen; William D. Lewis, Chesterfield, both of Va.; Jwohaw Thai, Shepherdsville, Ky.; Joseph C. Wirt, Midlothian, Va.

[73] Assignee: Reynolds Metals Company, Richmond, Va.

[21] Appl. No.: 849,566

[22] Filed: Mar. 11, 1992

[51] Int. Cl.[5] ..... B41F 9/02; B41F 19/02; B41M 1/24

[52] U.S. Cl. ..... 101/32; 101/170

[58] Field of Search ..... 101/22, 23, 32, 25, 101/152, 153, 170, 211, 485, 486, 490

[56] References Cited

U.S. PATENT DOCUMENTS

| | | | |
|---|---|---|---|
| 2,390,618 | 12/1945 | Roehm | 101/32 |
| 3,024,154 | 3/1962 | Singleton et al. | 101/23 X |
| 3,157,559 | 11/1964 | Menconi et al. | |
| 3,247,785 | 4/1966 | Shultz | 101/32 |
| 3,357,773 | 12/1967 | Rowland | |
| 3,462,226 | 8/1969 | Huffaker | 101/211 |
| 3,523,503 | 8/1970 | O'Boyle | 101/32 |
| 3,893,795 | 7/1975 | Nauta | 101/23 |
| 3,903,791 | 9/1975 | DeLigt | |
| 4,038,917 | 8/1977 | DeLigt | |
| 4,361,085 | 11/1982 | Schutz | |
| 4,646,634 | 3/1987 | Espe | |

*Primary Examiner*—J. Reed Fisher

*Attorney, Agent, or Firm*—Alan T. McDonald

[57] ABSTRACT

A method and apparatus for reflective enhancement of printed images includes forming a plurality of element schemes in the surface of a printed continuous web of material. The element schemes are in preselected registration with colors, shapes or densities of colors in the printed image. By controlling the various element schemes, the reflectivity of portions of the printed image may be enhanced.

12 Claims, 4 Drawing Sheets

METHOD AND APPARATUS FOR REFLECTIVE ENHANCEMENT OF ROTOGRAVURE PRINTED MATERIAL

FIELD OF THE INVENTION

The present invention relates to a reflective enhancement of printed material, in particular rotogravure printed material. Specifically, a plurality of elements are formed on printed material, the elements being in registration with colors and/or shapes of an image printed on the material. By proper selection of the various elements in registration with the colors and/or shapes, the image printed on the material is reflectively enhanced.

BACKGROUND ART

In the prior art, various processes and apparatus have been proposed to produce a texture on printed material. U.S. Pat. No. 3,247,785 to Shultz discloses a method and apparatus for texture embossing a sheet of material. In this patent, a metallic foil layer laminated to a paper backing layer is continually embossed with a textured embossing pattern. A pattern may consist of a series of hills and valleys arranged in a predetermined configuration. By arranging the hills and valleys in various angles relative to each other, a texture embossed pattern can give the appearance of a particular shape on the surface of the material even though the entire foil material is of the same color. However, the patent to Shultz does not recognize registering a plurality of patterns in a predetermined configuration with shapes and/or colors of above a printed image to reflectively enhance the printed image.

U.S. Pat. No. 3,157,559 to Menconi et al. discloses a multi-colored pictorial representation characterized by highlighting effects and a process for making same. In this patent, a pictorial representation is obtained wherein the pictorial representation is broken down by color separation. Striations are formed in the various colored areas with striations in adjacent colored areas extending in different directions to provide the highlighting effect. However, Menconi et al. does not teach or fairly suggest obtaining a density composite from the pictorial representation such that different patterns and different reflectivities may be put in registration within a given color or various shapes depicted in the pictorial representation. Moreover, Menconi et al. does not suggest non-linear patterns for enhancing reflectively such as circles, sinusoidal shapes or the like.

Another prior art process, typically called embossing, imparts a shape to a surface by passing a web of printed material through a pair of embossing rolls to create a three-dimensional effect. The embossing rolls include a plurality of matching male and female patterns which cooperate to form a raised shape on the web.

The embossing rolls are hand crafted by first making a shoe containing a male pattern. The shoe is then worked into the surface of one of the embossing rolls to form a plurality of female patterns therein. The spacing between the plurality of female patterns is also determined by the artisan manipulating the shoe. The spacing generally corresponds to the particular size of the article which is to be embossed by the embossing rolls.

After the female patterns are formed on one of the rolls, this roll is hardened and continually rolled against a soft second embossing roll. Due to the difference in hardness between the rolls, male patterns are formed on the second roll which correspond to the plurality of female patterns on the first roll.

The embossing rolls are then installed into a rotogravure printing press. The embossing rolls form a three-dimensional shape on the surface of the rotogravure printed image.

The method of rotogravure printing and apparatus therefor are well known in the prior art. In rotogravure printing, a printed image is produced using a copper cylinder on which an image has been engraved. The engraved image on the copper cylinder is produced using known methods. In a rotogravure printing press, a web is fed between a series of impression cylinders and engraved printing cylinders. Each of the printing cylinders revolves in ink fountains containing a particular colored ink. The ink is then rolled into the engraved printing cylinder in the fountain. A doctor blade wipes off the superfluous ink, which drops back into the fountain. The web is run against the cylinder utilizing a rubber impression roll of proper durometer to print the image sharp and clear on the web. The rotogravure presses may run multiple colors to print an image having a variety of color tones.

The techniques for developing the cylinders in rotogravure printing are also well known in the art. Typically, an image is broken down into a series of separations to isolate the various colors making up the image. From these color separations, the printing cylinders are engraved either photochemically or electromechanically for reproduction of the various colors used during printing in a rotogravure printing operation.

Drawbacks associated with the prior art techniques such as embossing in combination with rotogravure printing include difficulty in aligning the embossing elements with the printed image on the web. Since the elements on the embossing rolls are not always precisely aligned, registration is difficult to obtain. As a result of variations in spacing, registration between embossing and printing is difficult which leads to increased downtime and scrap during production to correct misalignment.

Further, misalignment of the embossing rolls may also result in cutting or damage to the web or elements on the embossing rolls due to the high hardness of the solid embossing rolls. In addition, the need for hand-crafting the embossing rolls contributes to high capital costs for producing the embossing rolls and printed material therefrom.

The prior art texture embossing methods and apparatus as taught in Shultz or Menconi et al. are disadvantageous in that these processes are limited to texture embossing for a single color or providing a single uniform pattern for a given color in a pictorial representation.

In response to the drawbacks and disadvantages of prior art techniques, a need has developed to provide improved ways to form a pattern, shape or texture on a printed web that provides for an enhancement of shapes and/or colors of a printed image.

In response to this need, the present invention provides an improved process and apparatus for imparting a shape or elements to a web of material having a printed image thereon. The present invention overcomes registration difficulties between prior art embossing and printing by eliminating the need for hand-crafting of the shape or pattern embossing rolls. The present invention also provides a novel reflectivity enhancement of a printed image by forming a plurality of differently shaped elements in the surface of a web. Moreover, the elements are in predetermined registration with shapes, colors or varying densities of the printed image to provide reflective enhancement of the image. The shape of the elements also provides a changing reflective enhancement by reflecting light in different directions depending on the orientation of the reflectively enhanced printed surface.

SUMMARY OF THE INVENTION

It is accordingly a first object of the present invention to provide an improved method and apparatus for reflective enhancement of printed material, in particular rotogravure printed material.

It is a further object of the present invention to provide a method and apparatus which permits enhancing reflectivity of shapes, colors, color tones or density variations of a printed material or portions thereof.

It is a still further object of the present invention to provide a method and apparatus for reflective enhancement of printed material which provides improved registration between reflective enhancing elements formed on a foil-faced printed material and printed shapes and/or colors thereon.

It is an even further object of the present invention to reflectively enhance a printed image such that different reflectivity is obtained depending on the orientation of the reflectively enhanced printed image with respect to a viewer.

Other objects and advantages of the present invention will become apparent as the description thereof proceeds..

In satisfaction of the foregoing objects and advantages, the present invention provides a method of enhancing the reflectivity of an image printed on the surface of a material comprising the steps of printing at least one image having a plurality of shapes and colors on the webbed material and forming a plurality of elements on the surface of the webbed material. Each element has a predetermined configuration and is in registration with at least one of the shapes, colors, color tones or combinations thereof of the printed image. The specific configuration of the element and registration with a portion of the printed image enhances the reflectivity of at least a portion of the printed image.

In particular, rotogravure printing may be used to print the image and the web of material may be passed between an element forming roll and a backup or impression roller to impart the desired elements into the surface of the material.

The present invention also provides an apparatus for enhancing the reflectivity of an image printed on a material which includes a printing press such as a rotogravure printing press having a printing station therewith to impart the desired elements into the surface of the web to reflectively enhance the printed image from the rotogravure printing process.

BRIEF DESCRIPTION OF THE DRAWINGS

Reference is now made to the drawings accompanying the invention, wherein.

DESCRIPTION OF THE PREFERRED EMBODIMENTS

The present invention relates to a method and apparatus for reflective enhancement of printed material, in particular, rotogravure printed material. In the inventive process, a web of material passes through a printing press such as a rotogravure printing press to print a plurality of images on the web of material.

The web of material having the printed images thereon then passes through an element forming station. The element forming station includes an impression roll and an element forming roll. The printed face of material contacts the element forming roll which forms a plurality of elements in the surface of the web. The plurality of elements formed are in predetermined registration with shapes and/or color or color densities of each printed image to provide reflective enhancement thereof.

By forming the plurality of elements on the material in registration with colors and/or shapes of the printed image, the reflectivity of the printed image may be enhanced. By configuring the various elements in predetermined relationships, the reflectivity of the printed image can be controlled to produce a more subtle image or an image having more contrast in colors and/or shapes. Moreover, by providing a plurality of different elements associated with the shapes and/or colors, the reflectivity enhancement of the printed image varies when the orientation of the image with respect to a viewer is altered. The inventive process and apparatus also provides lower capital and operating costs for the production of printed images on webs of material than prior art techniques such as three-dimensional embossing. The rolls forming the various elements in the web may be made using conventional photochemical or electromechanical techniques which offer considerable costs savings over processes requiring manufacture of matched steel embossing rolls.

Figure 1:
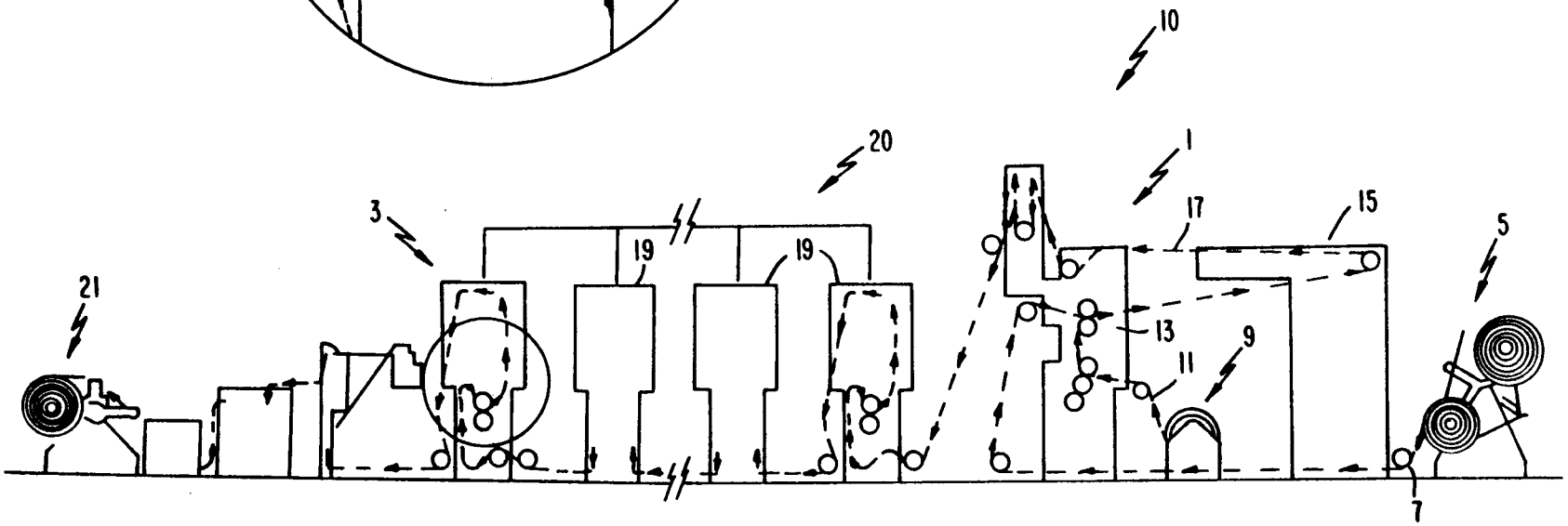
FIG. 1 shows a schematic view of one embodiment of the apparatus of the present invention.

With reference now to FIG. 1, a first embodiment of the apparatus of the present invention is generally designated by reference numeral 10 and is seen to include a rotogravure printing press 1 in combination with an element forming station 3 which forms the reflectivity enhancing elements on the printed web of material.

The rotogravure printing press 1 includes a payoff reel section 5 which pays off a substrate 7 into the printing press 1. The press 1 also includes a station 9 which can be used to pay off a strip of aluminum foil or film 11 to be laminated to the substrate 7. The substrate 7 and foil or film 11 pass through a glue laminating station 13 and an oven 15 which bonds the substrate 7 to the foil or film 11 to form a laminated web 17. The web 17, whether plain or laminated, then passes through a printing section 20 which comprises a plurality of printing stations 19 which apply a series of different colors to produce a final printed image on the web 17. The printing section is illustrated segmentally showing only three printing stations 19. Typically, the printing stations 19 would number seven or eight in sequence to achieve the desired color and tone on the web 17.

The web having the desired printed image thereon then passes through the element forming station 3 which forms a plurality of elements on the printed surface of the web 17. After the element forming station, the web 17 proceeds to a rewind wheel 21.

It should be understood that the rotogravure printing press depicted in FIG. 1 is merely exemplary of a printing apparatus for use with the present invention. Any printing apparatus capable of printing an image or plurality of images on a web of material may be used in combination with the element forming station 3 to produce a reflectivity enhanced printed image. The element forming station may be positioned before, after or in sequence with the printing apparatus as long as the necessary registration between elements and shapes or colors of the printed image are maintained. Furthermore, since rotogravure printing presses are well known in the art, further description of the specific components of the printing press such as the various rolls, control means, tensioning means and the like are not explained in greater detail.

Figure 2:
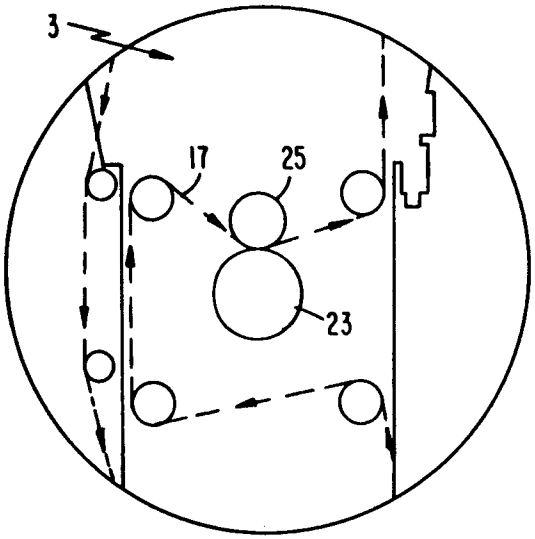
FIG. 2 shows an enlargement of the element forming station depicted in and encircled in FIG. 1.
Figure 3:
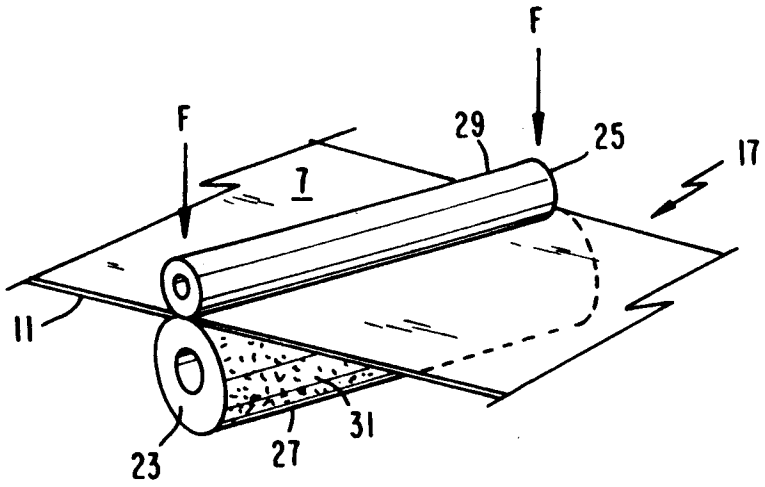
FIG. 3 shows a perspective view of the impression roll and element forming roll and web material depicted in FIG. 2.

With reference now to FIGS. 2 and 3, the element forming station 3 includes an element forming roll 23 and an impression roll 25 adjacent thereto. The web 17 is fed between the element forming roll 23 and impression roll 25 such that the printed face 11 contacts the surface 27 of the element forming roll 23 with the substrate 7 contacting the surface 29 of the impression roll 25. As will be described in greater detail below, the surface 27 of the element forming roll 23 has an engraved and raised element scheme 31 thereon. By application of a force indicated by the arrows F in FIG. 3, a predetermined amount of pressure is applied to the web 17 to displace a designated caliper of the printed face 11 of the web 17 to form the element scheme 31.

The impression roll 25 may be made of any material having sufficient durometer to permit displacement of the printed face 11 of the web 17. A preferred material includes polyurethane and a preferred durometer is about 100. The element forming roll 23 comprises a hollow steel shell having a copper plating thereon. As will be described hereinafter, the copper plating is engraved to form the element scheme 31 and subsequently plated with a chrome finish to enhance durability of the roll. The inventive process and apparatus provide advantages over prior art embossing technology by eliminating the requirement of a solid core construction for the embossing rolls.

Figure 4:
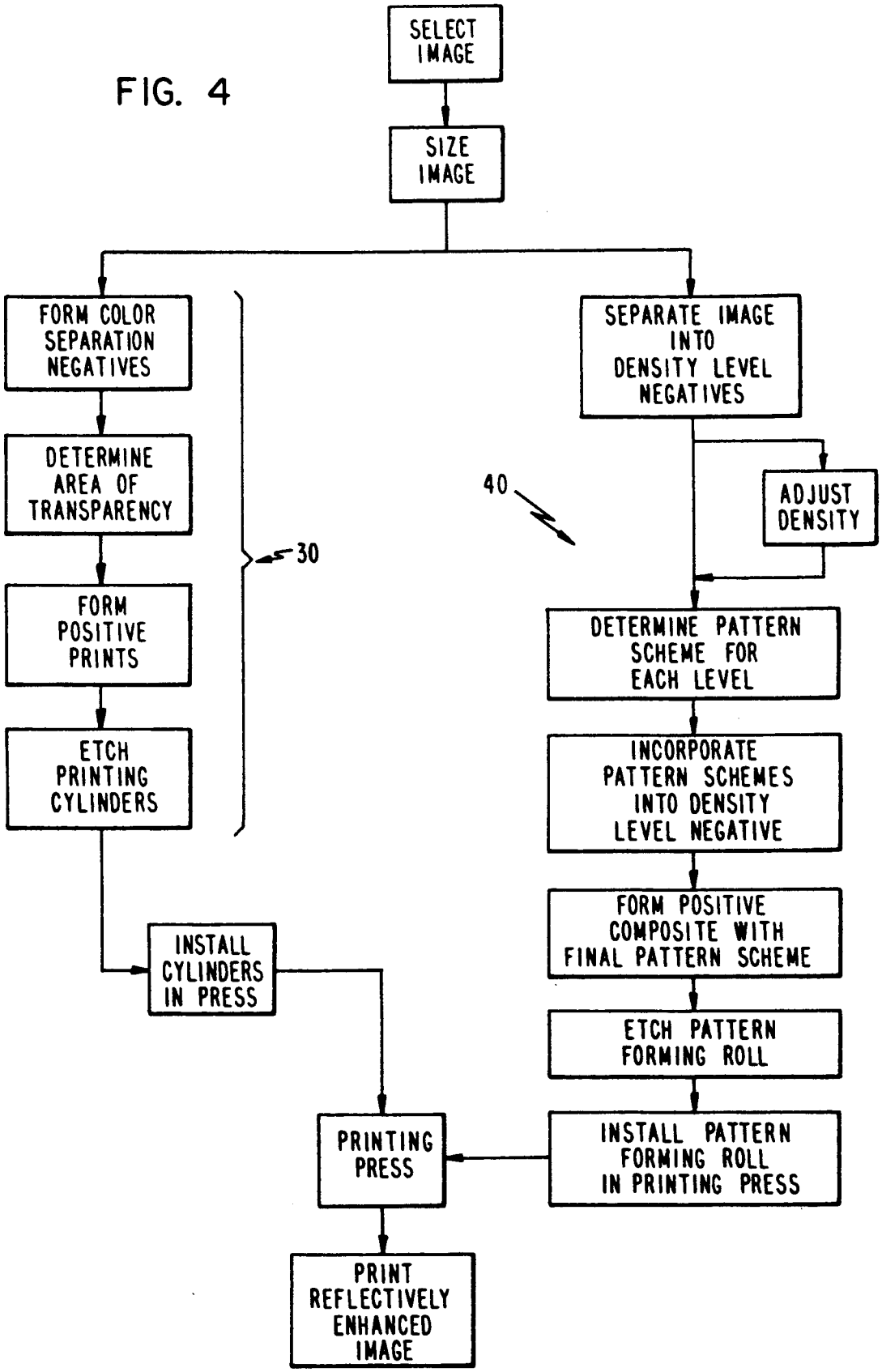
FIG. 4 shows a exemplary flowchart depicting the process steps to produce a reflectively enhanced printed image.

With reference to the flow chart depicted in FIG. 4, the manner in which registration is achieved between the printed image and the element scheme which reflectively enhances the printed image will now be described. First, an image is selected to be printed. For example, the image may comprise art work and labelling for a distilled spirits carton. Once an image has been selected, a color transparency is made of the image and adjusted in size according to the particular printing application. Once the image has been sized, the image is separated onto a series of separations which breakdown the individual colors making up the image to be printed.

At this point, an additional determination is made as to which areas of the image require opacity or transparency. This determination assists in the selection of transparent of opaque inks in conjunction with the rotogravure printing process. From these separations the rotogravure printing cylinders are produced. It should be understood that the process steps from producing the color separations to forming the printing cylinders for rotogravure printing are well known in the art and are not considered an aspect of the present invention. Accordingly, the specific process steps associated with the color separation and engraving of the rotogravure printing cylinders are not included in greater detail. The area of the flowchart admitted to be prior art is designated by the reference numeral 30.

With reference again to FIG. 4, the process steps associated with manufacture of the element forming roll to reflectively enhance the printed image are generally designated by the reference numeral 40. The first step in making the element forming roll is to separate the image into a series of density or color tone level negatives. This is done by generating a series of time exposures such that each time exposure is related to a different level of density associated with the image. Determination of the number of density levels is dependent upon the image to be printed. For example, an image having a high number of shapes or elements, i.e. a busy image, would require breakdown into a high number of density levels. In contrast, an image having a simpler image may require a lesser number of density levels. For example, a busy image may require six to eight time exposures whereas a simpler image may require only three or four.

Once the density level negatives are obtained, an optional step may be performed to adjust the opacity of a portion of a given density level negative. This may be required if one of the time exposures does not achieve the necessary opacity to correspond to the printed image. In this step, the negative may be painted using any known material for use in painting on negatives to increase the opacity of a given area. However, and as is evident from the flowchart in FIG. 4, the density of opacity adjusting step is optional if the density level negatives exhibit acceptable opacity.

After the density level negatives have been obtained, an element scheme is selected for each density level negative. The element scheme may be any element which will lend itself to obtaining the desired level of reflectively for a given portion of the image to be printed. For example, one element scheme may be a series of parallel lines. The parallel lines may range in size between 50 and 300 lines per linear inch. A coarse line structure, e.g. fewer lines per inch, results in higher reflectivity of the printed image. In contrast, a fine line structure such as 200 lines per linear inch would result in a less reflectivity or a more subtle printed image. Alternatively, the element scheme may be a series of circles, triangles or wavy or sinusoidal shaped lines.

When choosing a line element for association with a given density level negative, orientation of the line element can also affect the reflectivity of the printed image. For example, maximum reflectivity may be obtained when orientating the line element scheme in a horizontal configuration. Alternatively, the line element may be configured vertically to achieve a minimum amount of reflectivity of the printed image. Another configuration that contributes to high reflectivity is a series of parallel wavy lines.

It should be understood that one element or a plurality of elements may be associated with each density level negative. For example, a density level negative may consist of a generally horizontal line element or a combination of horizontal lines and lines oriented in angled relationship to the horizontal line element. The determination of the particular element scheme on each density level negative may also relate to the colors and/or shapes on the printed image. For example, a particular shape such as a wine bottle label or bottle cap may be desired to be highlighted on a printed carton. To achieve this desired highlighting, the density level negative displaying this portion of the image would incorporate an element scheme providing high reflection.

Once the element scheme is determined for each level, the various elements are incorporated into the individual density level negatives. This incorporation step is performed by contacting the portion of the density level negative desired to exhibit a particular element with a raw film containing the desired element. By exposing the composite raw film and density level negative, the element from the raw film is burned into the negative such that the density level negative includes the particular element in the raw film. For example, the raw film may be a line film having the desired line element density, e.g. 50–300 lines per linear inch. Alternatively, the raw film may consist of a series of circular or wavy line elements. If the raw film is of the line element type, the particular orientation of the line element on the negative may be achieved by rotation of the raw film and line element therein with respect to the density level negative.

Figure 5:
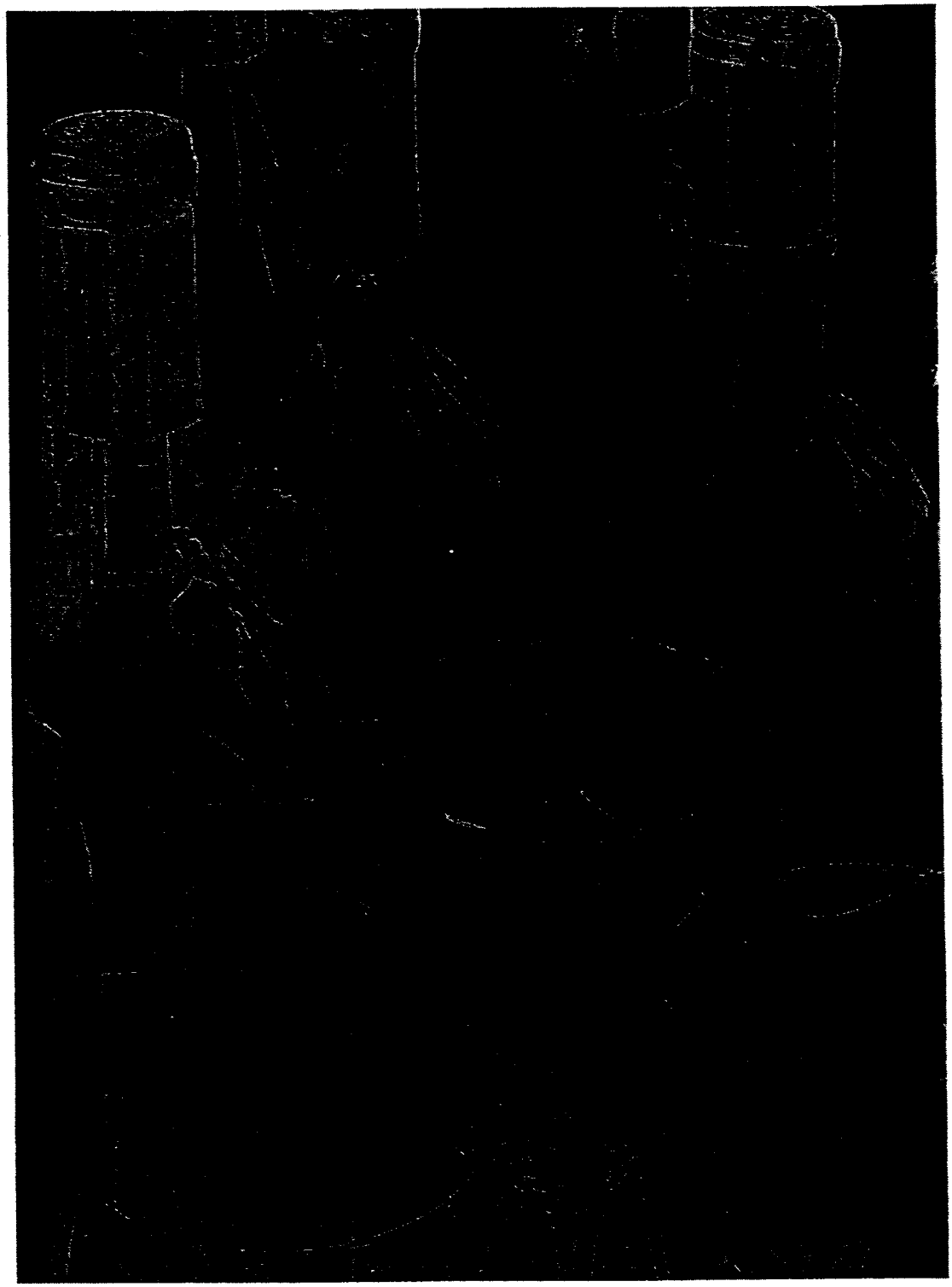
FIG. 5 shows an element forming photograph which is representative of a composite negative that would be used to engrave the overall element scheme in an element forming cylinder for use in the present invention.

After the appropriate element scheme has been incorporated into each density level negative, a final positive image density composite is formed incorporating all the preselected element schemes into one image. Formation of the positive image from a series of negatives in photography is a well known technique. Accordingly, further detailed description of forming the positive density composite is not included. With reference now to FIG. 5, a photograph illustrates an exemplary density composite. It should be understood that in making the element forming roll, the density composite is in the form of a transparency rather than the photograph indicated in FIG. 5. As can be seen from FIG. 5, the printed image of wine bottles and wine glasses comprises a plurality of differently configured elements to enhance reflectivity of the printed image.

Figure 6:
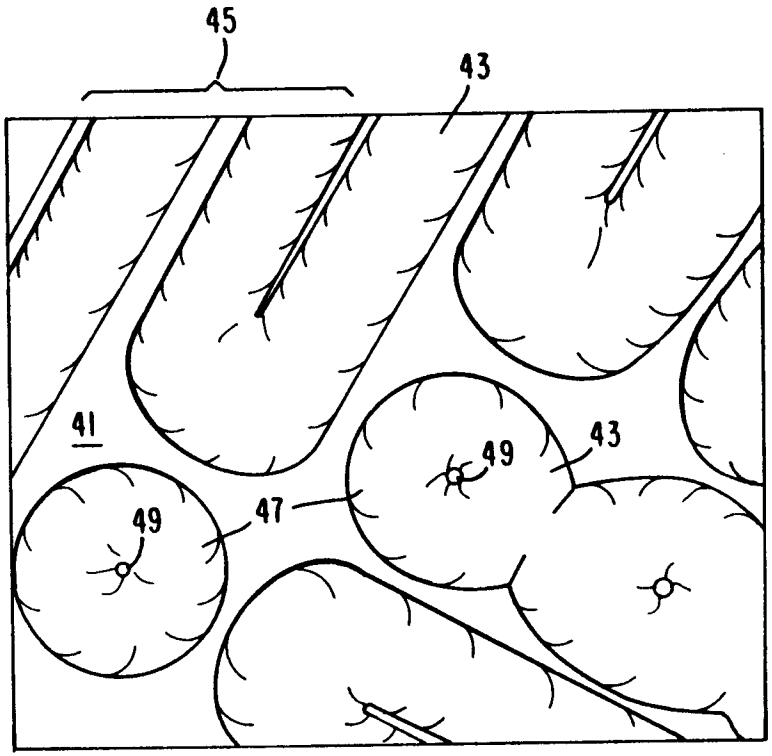
FIG. 6 shows a schematic diagram of a magnified surface portion of an element forming cylinder showing the grooves and ridges.

Once the final positive image density composite is formed, the final element scheme may be engraved on the element forming roll using conventional technology. As described above, the element forming roll is typically a hollow steel roll having a copper plating thereon. The copper plating is engraved such that the final element scheme forms a raised or male element on the surface of the roll. This male element is achieved by not only engraving the final element scheme in the surface of the roll but also engraving the remaining surface of the roll to a sufficient degree that the final element scheme is in a raised configuration. During the engraving process, the element scheme generally comprises a series of ridges and grooves. With reference now to FIG. 6, exemplary elements are illustrated showing ridges 41 and grooves 43. As exemplified in FIG. 6, the elements may consist of a series of parallel lines and grooves designated by the reference numeral 45 or alternatively, a series of circular grooves 47 with central ridge portions 49 therein. The depth of the grooves between the ridges may range from 10 microns and greater. Moreover, the groove depth may also affect the reflectivity of the printed image. For example, an element scheme having greater depth grooves will provide more contrast and increased reflection than an element scheme having shallower grooves.

It should be understood that the ridge and groove elements illustrated in FIG. 6 are merely exemplary and any element scheme capable of being transferred to the density level negatives can be utilized to enhance reflection of a printed image.

Although the reflective enhancement of printed images has been disclosed for rotogravure printing, any known printing method may be employed in combination with the element forming step and station as described above. In addition, although an aluminum foil laminated substrate has been illustrated as a typical web material for printing, any web having a surface that is capable of retaining a member shape imparted thereto can be used in the inventive process and apparatus. For example, a metallized surface consisting of metallic fibers, powders, or the like in a matrix material may be utilized in the printing process.

Using conventional techniques to etch the element scheme on the element forming roll permits improved registration to be obtained between the image printed on the web of material using the rotogravure press and the reflective enhancing elements. The control mechanism for maintaining registration between the various printing cylinders in the rotogravure printing press is known. The element forming station may be implemented into the registration control scheme associated with the rotogravure printing press. Since the registration control mechanism is considered to be well known in the prior art, and not considered an aspect of the invention, further details of the various components associated with the control scheme are not described herein.

The ability to provide a precise registration between the printed image and the elements for reflective enhancement of the printed image enables matching various element schemes to either colors, density of colors, shapes of objects or types of objects to be printed on a web of material. In matching elements to these variables associated with a printed image, degrees of reflectivity can be varied according to specific element variables. For example, by using less elements or fewer alternating elements, a more subtle, less reflective image may be created. Alternatively, an increasing number of elements or element orientations creates a higher contrast, more reflective image.

The novel reflectively enhanced article made by the inventive process and apparatus provides a reflective article having varying degrees of reflectivity in association with shapes, colors, varying color densities or tones of a printed image on these many types of substrates.

As such, an invention has been disclosed in terms of preferred embodiments thereof which fulfill each and every one of the objects of the present invention as set forth hereinabove and provides a new and improved method and apparatus for reflective enhancement of printed images.

Of course, various changes, modifications and alterations from the teachings of the present invention may be contemplated by those skilled in the art without departing from the intended spirit and scope thereof. Accordingly, it is intended that the present invention only be limited by the terms of the appended claims.

We claim:

1. A method of enhancing reflectivity of an image having a plurality of shapes and colors rotogravure printed on the surface of a web of material, said surface being capable of retaining a shape imparted thereon, comprising the steps of:

a) forming a plurality of varying density images from said image;

b) forming a plurality of enhanced reflectivity density images from said varying density images by combining each said varying density image with at least one reflectivity enhancing element;

c) forming an enhanced reflectivity composite image from said plurality of enhanced reflectivity density images;

d) forming an embossing roll from said enhanced reflectivity composite image;

e) printing said image on said surface of said web; and f) embossing said surface of said web with said enhanced reflectivity composite image, each said element having a predetermined configuration and being in registration with at least one of said shapes, said colors or a combination thereof such that at least a portion of said elements provided enhanced reflectivity for at least a portion of said image.

2. The method of claim 1 wherein said embossing step further comprises passing said web of material through means for forming said enhanced reflectivity composite image in said surface of said web.

3. The method of claim 2 wherein said passing step further comprises passing said web of material through a pair of rolls, a first roll being said embossing roll and a second roll having a durometer sufficient to permit formation of said enhanced reflectivity composite image in said surface of said web.

4. The method of claim 1 wherein said embossing step further comprises forming a plurality of ridges and grooves in said surface of said web, said ridges and grooves providing reflection of light to enhance reflectivity of said image.

5. The method of claim 1 wherein a said element is in registration with a shape and color of said image.

6. The method of claim 1 wherein a said element is in registration with a shape of said image.

7. The method of claim 1 wherein a said element is in registration with a shape of said image.

8. The method of claim 4 wherein said grooves are greater than 10 microns in depth.

9. The method of claim 4 wherein said ridges and grooves form a parallel line element.

10. The method of claim 9 wherein said line element ranges between 50 and 300 lines per linear inch.

11. The method of claim 4 wherein said ridges and grooves form a curved line element.

12. The method of claim 4 wherein said ridges and grooves form generally circular shapes.

* * * * *